US008556451B1

(12) United States Patent
Wilkinson

(10) Patent No.: US 8,556,451 B1
(45) Date of Patent: Oct. 15, 2013

(54) LINEAR LIGHTING FIXTURE

(75) Inventor: Jeremy F. Wilkinson, Lakewood, CO (US)

(73) Assignee: Cooper Technologies Company, Houston, TX (US)

( * ) Notice: Subject to any disclaimer, the term of this patent is extended or adjusted under 35 U.S.C. 154(b) by 601 days.

(21) Appl. No.: 12/771,015

(22) Filed: Apr. 30, 2010

(51) Int. Cl.
*F21V 21/00* (2006.01)

(52) U.S. Cl.
USPC ..... 362/217.05; 362/217.01; 362/217.02; 362/217.07; 362/217.08; 362/217.12

(58) Field of Classification Search
USPC ..... 362/217.01–217.17
See application file for complete search history.

(56) References Cited

U.S. PATENT DOCUMENTS

| | | | | |
|---|---|---|---|---|
| 1,913,517 | A | 6/1935 | Smith et al. | |
| 3,363,091 | A | 1/1968 | Cooper | |
| 3,991,905 | A | 11/1976 | Nicpon | |
| 3,997,778 | A | 12/1976 | Fieldstad | |
| 4,317,625 | A | 3/1982 | Van Allen | |
| 4,379,322 | A | 4/1983 | Kelly | |
| 4,412,276 | A | 10/1983 | Blinow | |
| 5,473,522 | A | 12/1995 | Kriz et al. | |
| 6,059,429 | A | 5/2000 | Bodell | |
| 6,154,945 | A | 12/2000 | Voelzke | |
| 6,238,066 | B1 | 5/2001 | Iwasaki | |
| 6,386,723 | B1 * | 5/2002 | Eberlein et al. | 362/33 |
| 6,652,113 | B2 | 11/2003 | Tant | |
| 6,773,135 | B1 | 8/2004 | Packer | |
| 6,902,303 | B2 | 6/2005 | Lee | |
| 7,229,192 | B2 | 6/2007 | Mayfield et al. | |
| 7,261,435 | B2 | 8/2007 | Gould et al. | |
| 7,377,672 | B2 | 5/2008 | Tickner et al. | |
| 7,455,422 | B2 | 11/2008 | Gould et al. | |
| 7,481,557 | B2 | 1/2009 | Gaines et al. | |
| 7,530,716 | B2 | 5/2009 | Mayfield et al. | |
| 7,635,198 | B2 | 12/2009 | Mayfield et al. | |
| 7,654,706 | B2 | 2/2010 | Tickner et al. | |
| 7,934,851 | B1 * | 5/2011 | Boissevain et al. | 362/241 |
| 2004/0085770 | A1 * | 5/2004 | Tyler et al. | 362/297 |
| 2005/0047129 | A1 | 3/2005 | Eppler et al. | |
| 2007/0171648 | A1 | 7/2007 | Tickner et al. | |
| 2007/0171658 | A1 | 7/2007 | Tickner et al. | |
| 2007/0171660 | A1 | 7/2007 | Wilkinson et al. | |
| 2007/0211457 | A1 | 9/2007 | Mayfield et al. | |
| 2009/0141487 | A1 | 6/2009 | Gould et al. | |
| 2010/0091484 | A1 | 4/2010 | Mayfield et al. | |

* cited by examiner

*Primary Examiner* — Sean Gramling
(74) *Attorney, Agent, or Firm* — King & Spalding LLP

(57) ABSTRACT

An asymmetric linear lighting fixture includes a linear housing having an opening, an internal component, and an asymmetric reflector. The reflector is removably snap-fitted to the housing and is positioned between the opening and the internal component. The housing includes a body, a first end cap coupled to one end of the body, and a second end cap coupled to an opposing end of the body. A lens and/or a louver are optionally snap-fitted to the housing and are used together or separately from one another within the fixture. Optionally, the body includes a track for positioning a mounting assembly at various locations along the track. The fixture optionally includes socket mounting brackets which allow for lamps of different lengths to be coupled within the housing. Additionally, a first asymmetric linear lighting fixture is continuously coupleable to a second asymmetric linear lighting fixture from a location that is external of the body.

15 Claims, 15 Drawing Sheets

LINEAR LIGHTING FIXTURE

TECHNICAL FIELD

The present invention relates generally to lighting fixtures and more particularly, to asymmetric linear lighting fixtures.

BACKGROUND

Conventional asymmetric linear lighting fixtures are typically inflexible and rigid in design. These conventional asymmetric linear lighting fixtures include one or more distinct areas of design inflexibilities which can cause a substantial increase in time for people installing and/or maintaining these conventional asymmetric linear lighting fixtures. Thus, installation costs and maintenance costs are unnecessarily increased when using these conventional asymmetric linear lighting fixtures.

One of the distinct areas of design inflexibilities includes the requirement of tools for accessing one or more internal components of the conventional asymmetric linear lighting fixtures that can require maintenance. For example, when servicing a ballast within the conventional asymmetric linear lighting fixtures, at least one of the lens, louver, or reflector requires a tool for disassembly so that access can be made to the ballast. For instance, the reflector can be screwed into the housing a tool. When tools are used to access certain internal components, the time and efforts expended by the maintainer is increased; thereby increasing costs. Additionally, when the correct tools are not available, the maintenance of the internal components is delayed and productivity that depends upon the lighting provided by that conventional asymmetric linear lighting fixture is decreased, which also increases costs and/or decreases revenue.

Another distinct area of design inflexibilities includes the fixed position of mounting arms that are positioned along the backsides of conventional asymmetric linear lighting fixtures. When installing these conventional asymmetric linear lighting fixtures, an installer generally has to perform complex field adjustments to properly install the conventional asymmetric linear lighting fixtures. For example, conventional asymmetric linear lighting fixtures having two or more mounting arms may not have the mounting arms in proper alignment with an electrical J-box and/or a wall stud, which provides support to the conventional asymmetric linear lighting fixtures when mounted. The installer may have to tear down a portion of the mounting platform, and move the electrical J-box and/or add additional bracing or studs for properly mounting the conventional asymmetric linear lighting fixtures. Once making the proper adjustments, the installer will have to wait for another person to redo the portion of the mounting platform that was torn down. This design inflexibility within the conventional asymmetric linear lighting fixtures causes increased installation times and, at times, repetition of work previously performed; thereby unnecessarily increasing installation costs.

Another distinct area of design inflexibilities includes the continuous mounting feature of two or more conventional asymmetric linear lighting fixtures. When mounting two conventional asymmetric linear lighting fixtures in a row, components of each of the conventional asymmetric linear lighting fixtures are removed so that the conventional asymmetric linear lighting fixtures are coupled together from within the housings of each conventional fixture using a bolt, screw, or other fastening device. Since components for each conventional asymmetric linear lighting fixture have to be removed to access the interior of the housing, the time expended and the installation costs associated with continuously mounting two or more conventional asymmetric linear lighting fixtures together in a row are unnecessarily increased.

Another distinct area of design inflexibilities includes the ability for using different lamp sizes within the same conventional asymmetric linear lighting fixture. Many conventional asymmetric linear lighting fixtures use fluorescent lamps, or other lamp types, and are designed to use a particular lamp size. Lamps can be purchased in various sizes, for example, T5 and T8. Typically, when a user desires to change lamp sizes to increase or decrease the illumination level, the user purchases a different conventional asymmetric linear lighting fixture that is capable of housing the different lamp size and replaces the existing conventional asymmetric linear lighting fixture. This design inflexibility increases the cost associated with changing lamp sizes.

Another distinct area of design inflexibilities includes the louver option. The louver is typically coupled to housing of the conventional asymmetric linear lighting fixture using screws, bolts, or other fastening devices. Thus, to access internal components, tools are typically used to uninstall the louver; thereby increasing time and costs for installation and/or maintenance of the conventional asymmetric linear lighting fixture. Additionally, the conventional asymmetric linear lighting fixture is designed to have a louver with a lens or to have a louver without a lens, but is not designed to be freely interchangeable between the two options. The conventional asymmetric linear lighting fixture is not flexibly designed to have the user decide whether to use a louver with or without a lens.

SUMMARY

One embodiment of the present invention includes an asymmetric linear lighting fixture. The asymmetric linear lighting fixture can include a linear housing, one or more internal components, and an asymmetric reflector. The linear housing can include an internal surface and an external surface. The housing can form an opening along a portion of the external surface and a cavity that extends from the opening into the interior of the housing, which forms the internal surface. The internal components can be coupled to a portion of the housing within the cavity. The asymmetric reflector can be removably snap-fitted to the housing and disposed within the cavity. The asymmetric reflector can be positioned between the internal components and the opening.

Another embodiment of the present invention includes an asymmetric linear lighting fixture. The asymmetric linear lighting fixture can include a linear housing and one or more mounting assemblies. The linear housing can include a bottom side. The bottom side can include one or more tracks extending at least a portion of the length of the housing. The one or more mounting assemblies can be securely coupled to one or more desired locations on the track. The mounting assembly can be positionable at various locations along the track.

Another embodiment of the present invention includes an asymmetric linear lighting fixture. The asymmetric linear lighting fixture can include a linear housing, an asymmetric reflector, and a louver. The linear housing can form an opening. The opening can include a first longitudinal side and a second longitudinal side that extend along an external surface of the housing. The housing can include a first longitudinal channel and a second longitudinal channel. The first longitudinal channel can be positioned adjacent the first longitudinal side and within the interior of the housing. The second longitudinal channel can be positioned adjacent the second longitudinal side and within the interior of the housing. The second longitudinal channel can be substantially parallel to the first longitudinal channel. The asymmetric reflector can include a first longitudinal end and a second longitudinal end. The first longitudinal end can include one or more tabs extending outwardly therefrom. The second longitudinal end can include one or more tabs extending outwardly therefrom. Each of the tabs of the first longitudinal end can be positioned within at least a portion of the first longitudinal channel. Each of the tabs of the second longitudinal end can be positioned within at least a portion of the second longitudinal channel. The reflector can be removably snap-fitted to the housing. The louver can include a first longitudinal edge and a second longitudinal edge. The first longitudinal edge can include one or more fasteners. A portion of the fasteners can be positioned within a portion of the first longitudinal channel. The second longitudinal edge can be positioned within at least a portion of the second longitudinal channel. The first and second longitudinal edges can be disposed between the first longitudinal end and the first longitudinal side and the second longitudinal end and the second longitudinal side respectively. The louver can be removably snap-fitted to the housing.

Another embodiment of the present invention includes a linear lighting fixture. The linear lighting fixture can include a housing, a reflector, a first socket mounting bracket, and a second socket mounting bracket. The housing can form an opening therein. The reflector can be coupled to the housing and disposed within the housing. The first socket mounting bracket can be disposed at substantially one end of the housing in a first direction. The second socket mounting bracket can be disposed at substantially an opposing end of the housing in a second direction. The first direction can be opposite the second direction. Each socket mounting bracket can include at least a first socket mounting location and a second socket mounting location. When each socket mounting bracket receives a socket at the first socket mounting locations, a light source having a first length can be coupleable to each of the sockets. When each socket mounting bracket receives a socket at the second socket mounting locations, a light source having a second length can be coupleable to each of the sockets. The first length can be different than the second length.

Another embodiment of the present invention includes an asymmetric continuous linear lighting fixture system. The asymmetric continuous linear lighting fixture system can include a fastener, a first asymmetric linear lighting fixture, and a second asymmetric linear lighting fixture. The first asymmetric linear lighting fixture can include a linear housing that includes an opening therein. The housing can include a body, a first end cap, and a second end cap. The body can include a cavity. The first end cap can be coupled to one end of the body. At least a portion of the first end cap can extend beyond the profile of the body and can include a passageway. The second end cap can be coupled to an opposing end of the body. The second asymmetric linear lighting fixture can be positioned adjacent to the first asymmetric linear lighting fixture. The second asymmetric linear lighting fixture can include a linear housing that includes an opening therein. The housing can include a body, a first end cap, and a second end cap. The body can include a cavity. The first end cap can be coupled to one end of the body. The second end cap can be coupled to an opposing end of the body. At least a portion of the second end cap can extend beyond the profile of the body and can include a passageway. The passageway of the second asymmetric linear lighting fixture can be aligned with the passageway of the first asymmetric linear lighting fixture. The fastener can be inserted through the passageway of the second asymmetric linear lighting fixture and the passageway of the first asymmetric linear lighting fixture to securely couple the first asymmetric linear lighting fixture to the second asymmetric linear lighting fixture.

BRIEF DESCRIPTION OF THE DRAWINGS

The foregoing and other features and aspects of the invention are best understood with reference to the following description of certain exemplary embodiments, when read in conjunction with the accompanying drawings, wherein.

The drawings illustrate only exemplary embodiments of the invention and are therefore not to be considered limiting of its scope, as the invention may admit to other equally effective embodiments.

BRIEF DESCRIPTION OF EXEMPLARY EMBODIMENTS

The present invention is directed to asymmetric linear lighting fixtures. Although the description of exemplary embodiments is provided below in conjunction with a fluorescent lamp, alternate embodiments of the invention may be applicable to other types of lamps in linear form, including, but not limited to, light emitting diodes ("LEDs"), compact fluorescent lamps, organic light emitting diodes, a combination of different lamp types, or other lamp types known to persons having ordinary skill in the art. Additionally, lamp types developed using future technology are included for use within one or more exemplary embodiments of the present invention.

Figure 1A:
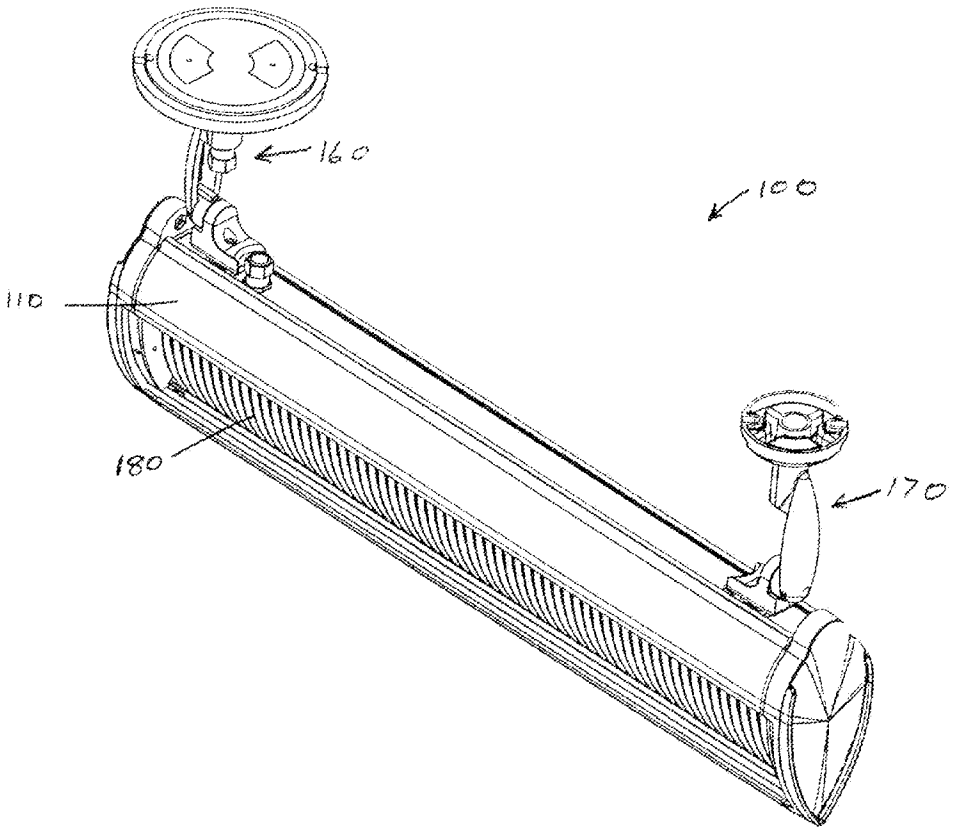
FIG. 1A is a front perspective view of an asymmetric linear lighting fixture in accordance with an exemplary embodiment of the present invention.
Figure 1B:
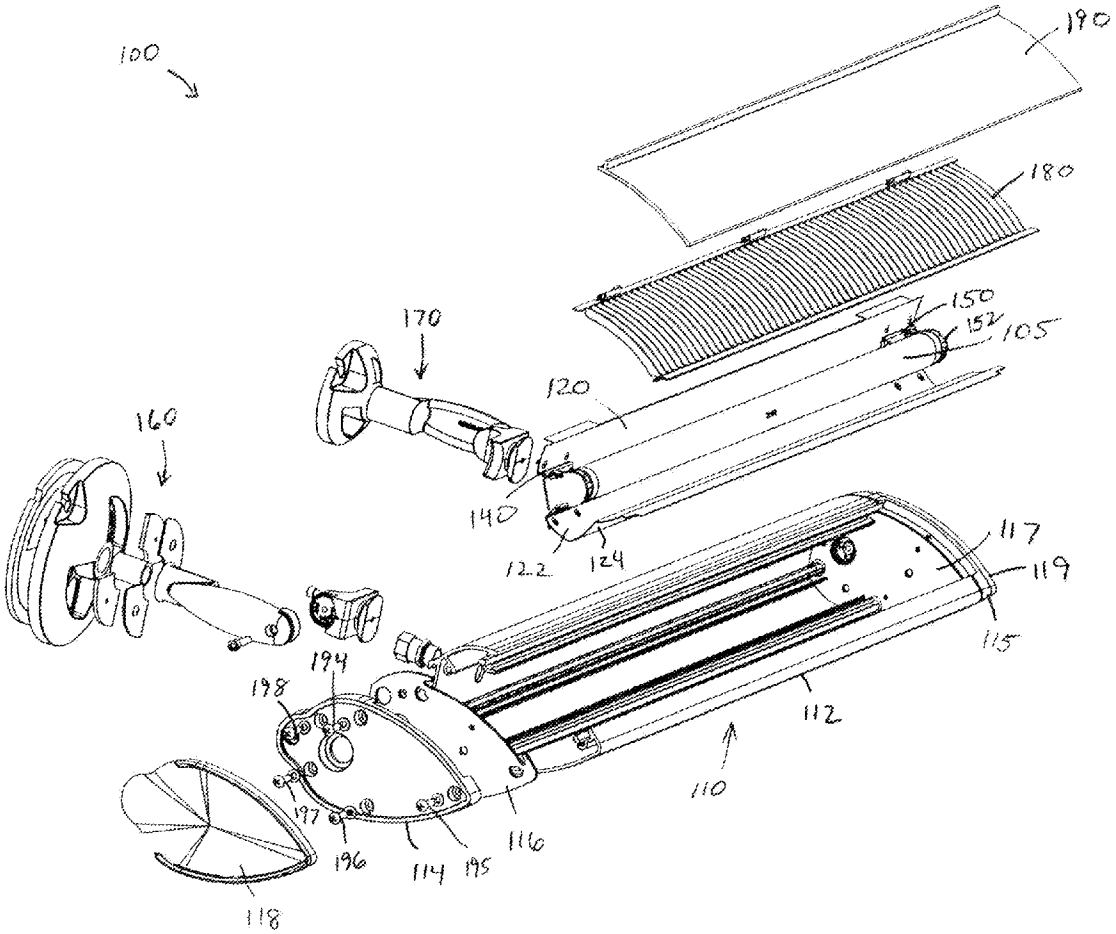
FIG. 1B is an exploded view of the asymmetric linear lighting fixture of FIG. 1A in accordance with an exemplary embodiment of the present invention.
Figure 1C:
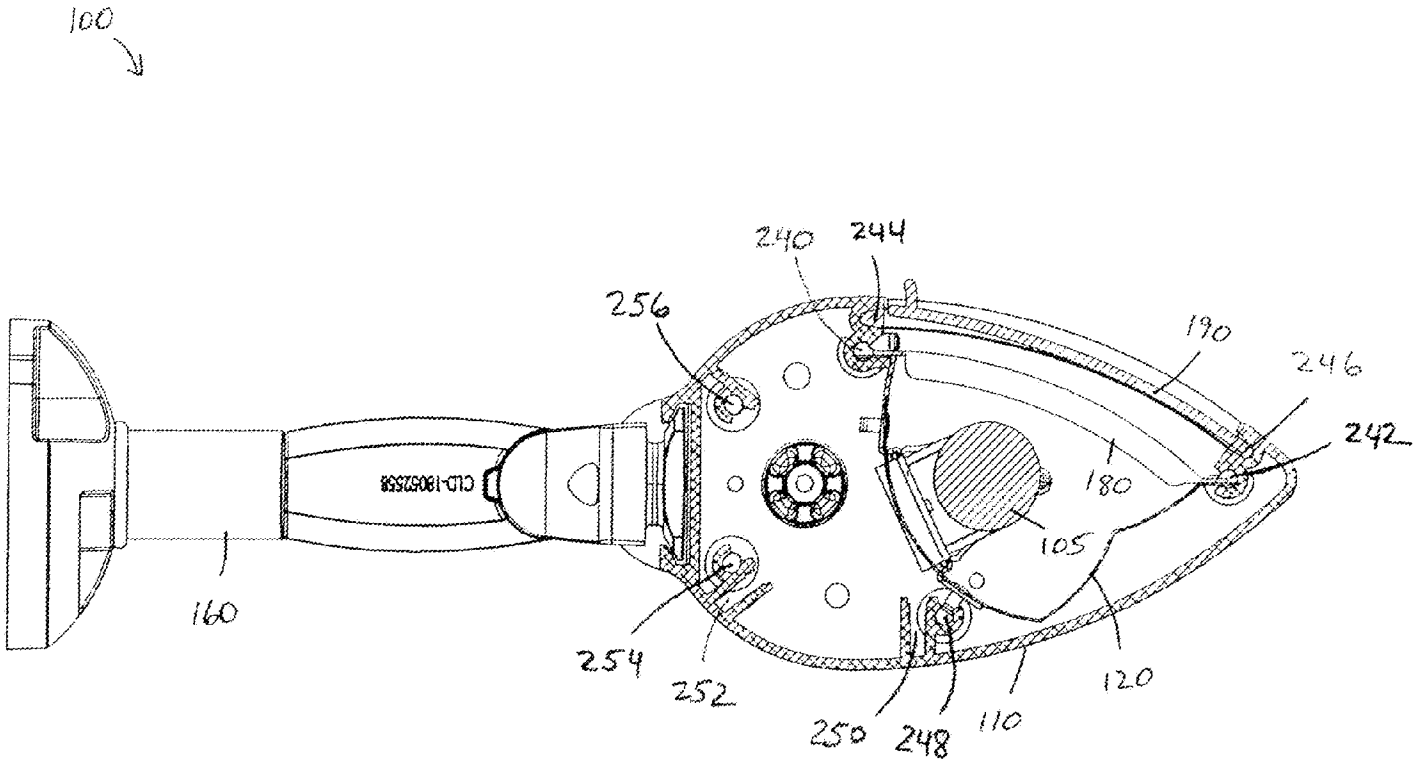
FIG. 1C is a cross-sectional view of the asymmetric linear lighting fixture of FIG. 1A in accordance with an exemplary embodiment of the present invention.

The invention is better understood by reading the following description of non-limiting, exemplary embodiments with reference to the attached drawings, wherein like parts of each of the figures are identified by like reference characters, and which are briefly described as follows. FIG. 1A is a front perspective view of an asymmetric linear lighting fixture 100 in accordance with an exemplary embodiment of the present invention. FIG. 1B is an exploded view of the asymmetric linear lighting fixture 100 of FIG. 1A in accordance with an exemplary embodiment of the present invention. FIG. 1C is a cross-sectional view of the asymmetric linear lighting fixture 100 of FIG. 1A in accordance with an exemplary embodiment of the present invention. Referring to FIGS. 1A-1C, the asymmetric linear lighting fixture 100 includes a linear housing 110, an asymmetric reflector 120, a light source 105, one or more socket mounting brackets 140 and 150, and one or more mounting assemblies 160 and 170. In some exemplary embodiments, the asymmetric linear lighting fixture 100 optionally includes a louver 180 and/or a lens 190. In other exemplary embodiments, the asymmetric linear lighting fixture 100 also includes one or more internal components 205 (FIG. 2A).

The linear housing 110 includes a body 112, a first end cap 114 coupled to one end of the body 112, and a second end cap 115 coupled to an opposing end of the body 112. In certain exemplary embodiments, the linear housing 110 optionally includes a first end cap gasket 116 and a second end cap gasket 117, wherein both the first end cap gasket 116 and the second end cap gasket 117 are fabricated using non-conductive materials, such as silicone or some other suitable material known to people having ordinary skill in the art. The first end cap gasket 116 and the second end cap gasket 117 are disposed between the first end cap 114 and the one end of the body 112 and the second end cap 115 and the opposing end of the body 112, respectively. The end cap gaskets 116 and 117 provide an electrical insulation barrier between the body 112 and each of the first end cap 114 and the second end cap 115. In other exemplary embodiments, the linear housing 110 also optionally includes a first side decorative panel 118 and a second side decorative panel 119. The first side decorative panel 118 is friction fitted to the first end cap 114, while the second side decorative panel 119 is friction fitted to the second end cap 115. However, other methods known to people having ordinary skill in the art, such as using screws, rivets, or other suitable known fastening devices, can be used to couple the first side decorative panel 118 and the second side decorative panel 119 to the first end cap 114 and the second end cap 115, respectively.

Figure 2A:
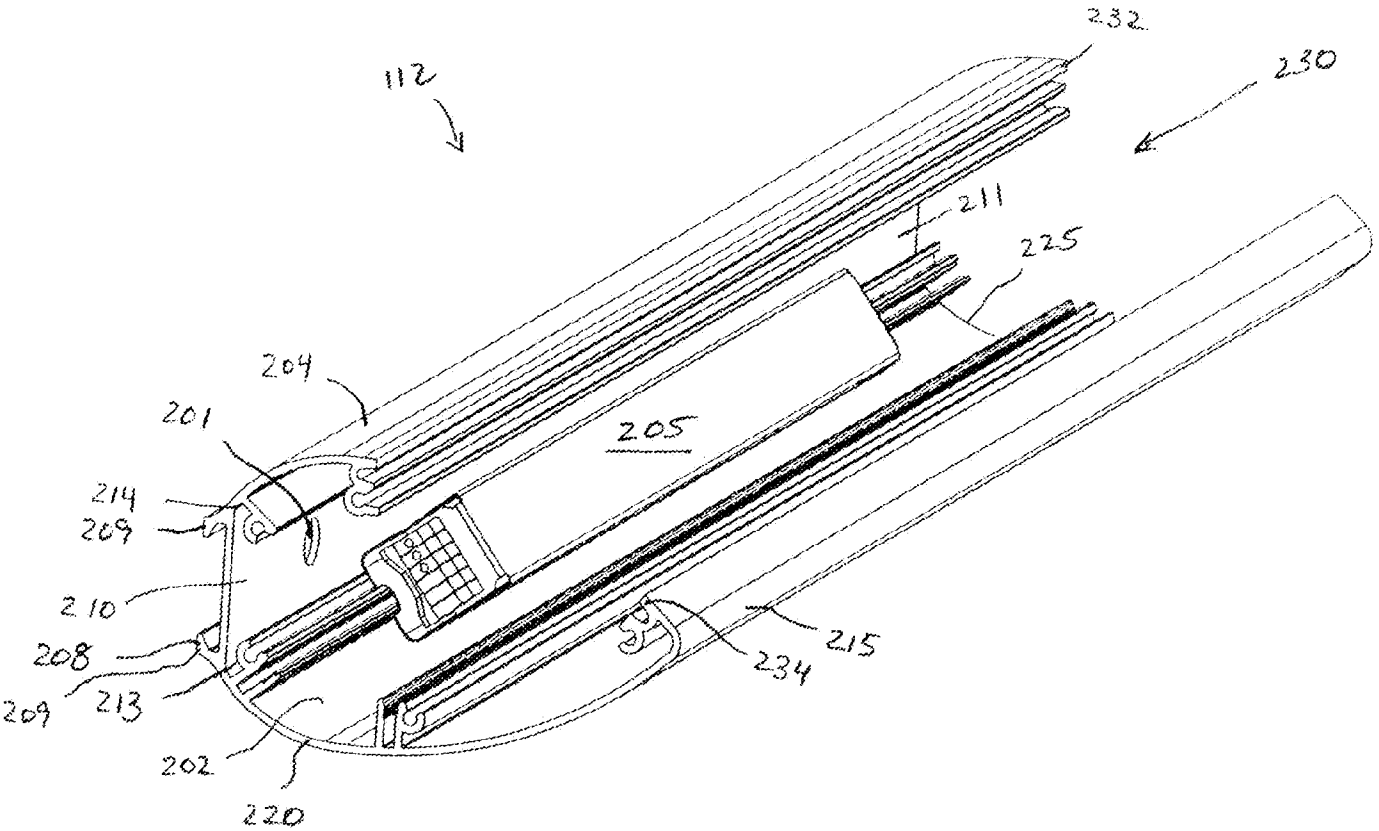
FIG. 2A is a front perspective view of the body of FIG. 1B in accordance with an exemplary embodiment of the present invention.
Figure 2B:
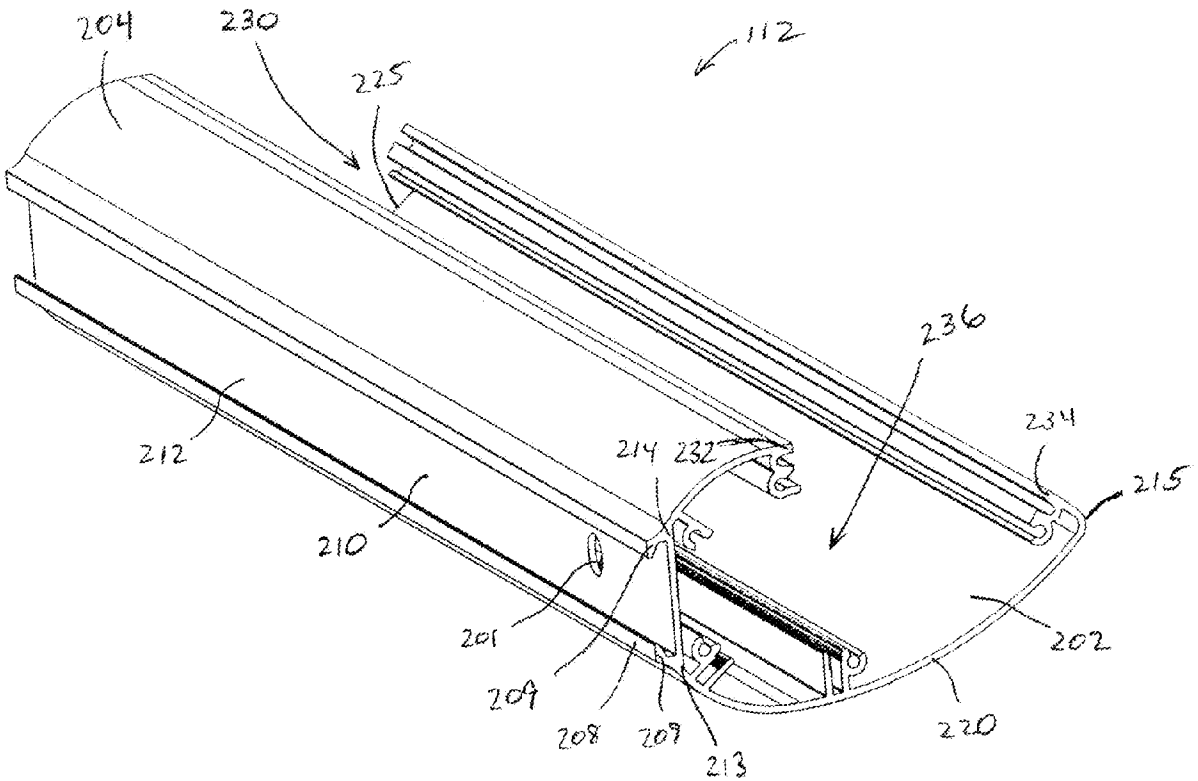
FIG. 2B is a rear perspective view of the body of FIG. 2A in accordance with an exemplary embodiment of the present invention.
Figure 2C:
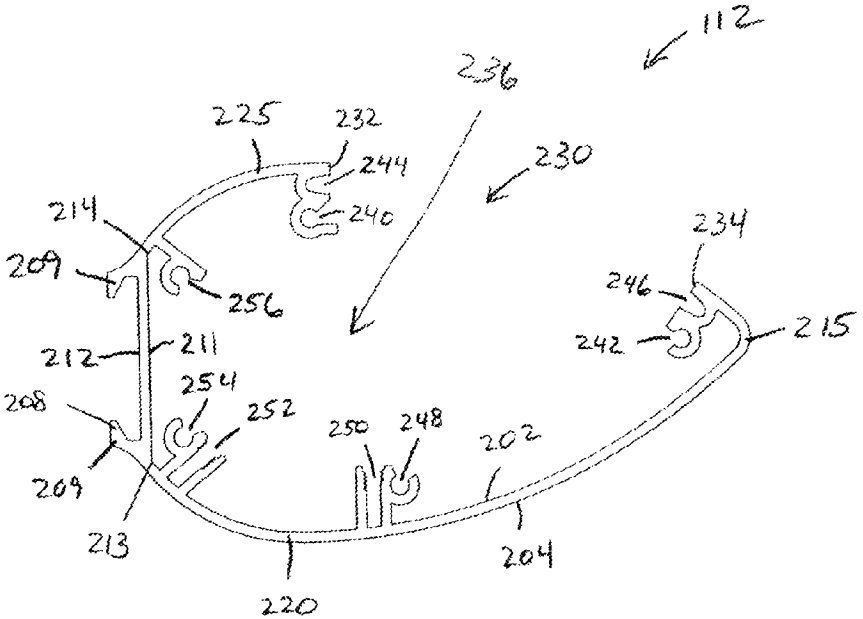
FIG. 2C is a cross-sectional view of the body of FIG. 2A in accordance with an exemplary embodiment of the present invention.

FIG. 2A is a front perspective view of the body 112 of FIG. 1B in accordance with an exemplary embodiment of the present invention. FIG. 2B is a rear perspective view of the body 112 of FIG. 2A in accordance with an exemplary embodiment of the present invention. FIG. 2C is a cross-sectional view of the body 112 of FIG. 2A in accordance with an exemplary embodiment of the present invention. Referring to FIGS. 2A-2C, the body 112 has a cross-sectional shape that is similar to an arrowhead, or a teardrop. The body 112 extends linearly lengthwise. The body 112 includes a bottom side 210, a top side 215, a first side 220, a second side 225, an internal surface 202, and an external surface 204.

The bottom side 210 is substantially planar and includes an interior surface 211, an exterior surface 212, a first longitudinal edge 213, and a second longitudinal edge 214. The bottom side 210 includes an aperture 201 proceeding from the exterior surface 212 to the interior surface 211 that allows one or more electrical wires (not shown) to pass through. The electrical wires are electrically coupled to the light source 105 (FIG. 1B) that is housed within the housing 110 (FIG. 1A) and to a power source (not shown). A track 208 extends outwardly from the exterior surface 212 of the bottom side 210 along the entire length of the bottom side 210. The track 208 includes a lip 209 on each longitudinal side of the track 208, which extends the length of the track 208. However, the track 208 extends a portion of the length of the bottom side's external surface 212 according to other exemplary embodiments. In alternative exemplary embodiments, more than one track 208 extends along portions of the length of the bottom side's external surface 212. Although the bottom side 210 is substantially planar, the bottom side 210 is non-planar in other exemplary embodiments. The top side 215 substantially forms a point, or a tip of an arrowhead, and extends the length of the body 112. However, the top side 215 has other shapes, such as a rounded tip or any other suitable shape, without departing from the scope and spirit of the exemplary embodiment. The first side 220 is convexed-shaped and extends from the entire length of the bottom side's first longitudinal edge 213 to the entire length of the top side 215 in a direction opposite of the track 208. The second side 225 also is substantially convexed-shaped and extends from the entire length of the bottom side's second longitudinal edge 214 to the entire length of the top side 215 in a direction opposite of the track 208; however, an opening 230 is formed along a portion of the second side 225.

Opening 230 extends the entire length of the body 112; however, the opening 230 extends a portion of the length of the body 112 in other exemplary embodiments. The opening 230 forms a first longitudinal side 232 and a second longitudinal side 234 that extend substantially the length of the body 112. A cavity 236 is formed within the body 112 and extends from the opening 230 into the interior of the body 112, thereby forming the internal surface 202.

The body 112 also includes one or more longitudinal channels 240, 242, 244, 246, 248, 250, 252, 254, and 256 extending from one end of the body 112 to the opposing end of the body 112 along the internal surface 202 of the body 112. Although nine longitudinal channels are illustrated in the exemplary embodiment, there are greater or fewer longitudinal channels in other exemplary embodiments without departing from the scope and spirit of the exemplary embodiment. Additionally, although the longitudinal channels 240, 242, 244, 246, 248, 250, 252, 254, and 256 extend substantially the length of the body 112, one or more of the longitudinal channels extend at least a portion of the length of the body 112 according to alternative exemplary embodiments.

A first longitudinal channel 240 is positioned adjacent the opening's first longitudinal side 232. A second longitudinal channel 242 is positioned adjacent the opening's second longitudinal side 234. A third longitudinal channel 244 is positioned between the opening's first longitudinal side 232 and the first longitudinal channel 240 and is coupled to both the opening's first longitudinal side 232 and the first longitudinal channel 240. A fourth longitudinal channel 246 is positioned between the opening's second longitudinal side 234 and the second longitudinal channel 242 and is coupled to both the opening's second longitudinal side 234 and the second longitudinal channel 242. Although the exemplary embodiment illustrates that the first longitudinal channel 240, the second longitudinal channel 242, the third longitudinal channel 244, and the fourth longitudinal channel 246 are located within the cavity 236, one or more of the first longitudinal channel 240, the second longitudinal channel 242, the third longitudinal channel 244, and the fourth longitudinal channel 246 are positioned external to the cavity 236 in other exemplary embodiments.

The fifth longitudinal channel 248 and the sixth longitudinal channel 250 are positioned adjacent one another and extend inwardly from about the middle of the body's first side 220 into the cavity 236. The seventh longitudinal channel 252 and the eighth longitudinal channel 254 are positioned adjacent one another and extend inwardly from the body's first side 220, at about where the body's first side 220 meets with the body's bottom side 210, into the cavity 236. The ninth longitudinal channel 256 extends inwardly from the body's second side 225, at about where the body's second side 225 meets with the body's bottom side 210, into the cavity 236. Each of the longitudinal channels 240, 242, 244, 246, 248, 250, 252, 254, and 256 are substantially parallel to one another.

A ballast 205, one example of an internal component, is coupled to a portion of the body 112. In one example, the ballast 205 is coupled to the seventh longitudinal channel 252 using one or more screws (not shown) that proceed into the seventh longitudinal channel 252. The screws enter into the seventh longitudinal channel 252 perpendicularly to the direction of the seventh longitudinal channel 252. However, in alternative exemplary embodiments, the ballast 205 is coupled to another portion of the housing 110 (FIG. 1A), such as the first end cap 114, the second end cap 115, one or more of the longitudinal channels 240, 242, 244, 246, 248, 250, 252, 254, and 256, and/or the internal surface 202 of the body 112. In some exemplary embodiments, the ballast 205 is positioned remotely from the body 112 or on the external surface 204 of the body 112 without departing from the scope and spirit of the exemplary embodiment.

Figure 3:
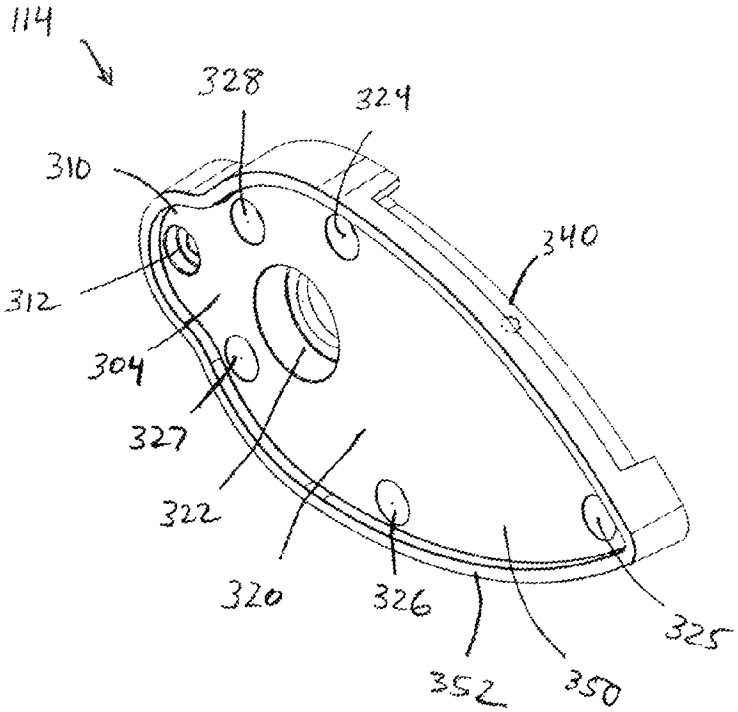
FIG. 3 is a perspective view of the end caps of FIG. 1B in accordance with an exemplary embodiment of the present invention.

FIG. 3 is a perspective view of the end caps 114 and 115 of FIG. 1B in accordance with an exemplary embodiment of the present invention. Referring to FIGS. 1B, 2C, and 3, the first end cap 114 and the second end cap 115 are similar in construction and are therefore described with respect to the first end cap 114. The shape of the end caps 114 and 115 is substantially similar to the shape of the cross-section of the body 112, which is arrowhead or teardrop in shape, except for a first portion 310. The first end cap 114 includes the first portion 310, a second portion 320, an internal surface (not shown), and an external surface 304. The first portion 310 and the second portion 320 are integrally formed as a single component; however, the first portion 310 and the second portion 320 are separately formed in other exemplary embodiments.

The first portion 310 has a curvature shape that extends beyond the profile, or cross-section, of the body 112 once the first end cap 114 is coupled to one end of the body 112. Thus, once the first end cap 114 is coupled to one end of the body 112, the internal surface of the first portion 310 is not positioned adjacent the body's cavity 236. Instead, the internal surface of the first portion 310 is positioned adjacent one end of the track 208. Although the first portion 310 is illustrated as being shaped in a curvature, the first portion 310 is shaped in any geometric or non-geometric shape according to alternative exemplary embodiments. The first portion 310 includes an aperture 312 proceeding from the external surface 304 to the internal surface that allows a screw, bolt, or other known fastening device to be inserted therethrough, which is described in further detail with respect to FIG. 11. Although the first portion 310 extends beyond the profile, or cross-section, of the body 112 once the first end cap 114 is coupled to one end of the body 112, any other portion of the first end cap 114 can be extended beyond the profile of the body 112 once the first end cap 114 is coupled to one end of the body 112 to facilitate the function described with respect to FIG. 11.

The second portion 320 is shaped similarly to the cross-sectional shape of the body 112 and is positioned adjacent the cavity 236 once the first end cap 114 is coupled to one end of the body 112. Thus, once the first end cap 114 is coupled to one end of the body 112, the internal surface of the second portion 320 is positioned adjacent the body's cavity 236, or is accessible through the cavity 236. The second portion 320 includes an opening 322 proceeding from the external surface 304 to the internal surface that allows one or more electrical wires to proceed therethrough, which is described in further detail with respect to FIG. 11. The second portion 320 also includes five passageways 324, 325, 326, 327, and 328 that extend from the external surface 304 to the internal surface. Each passageway 324, 325, 326, 327, and 328 is aligned with a single respective longitudinal channel once the first end cap 114 is coupled to the one end of the body 112.

A first passageway 324 is aligned with the first longitudinal channel 240 and allows for a first screw 194 to proceed through the first passageway 324 and engage the first longitudinal channel 240. The first screw 194 is oriented in a direction that is parallel with the direction of the first longitudinal channel 240. A second passageway 325 is aligned with the second longitudinal channel 242 and allows for a second screw 195 to proceed through the second passageway 325 and engage the second longitudinal channel 242. The second screw 195 is oriented in a direction that is parallel with the direction of the second longitudinal channel 242. A third passageway 326 is aligned with the fifth longitudinal channel 248 and allows for a third screw 196 to proceed through the third passageway 326 and engage the fifth longitudinal channel 248. The third screw 196 is oriented in a direction that is parallel with the direction of the fifth longitudinal channel 248. A fourth passageway 327 is aligned with the seventh longitudinal channel 252 and allows for a fourth screw 197 to proceed through the fourth passageway 327 and engage the seventh longitudinal channel 252. The fourth screw 197 is oriented in a direction that is parallel with the direction of the seventh longitudinal channel 252. A fifth passageway 328 is aligned with the ninth longitudinal channel 256 and allows for a fifth screw 198 to proceed through the fifth passageway 328 and engage the ninth longitudinal channel 256. The fifth screw 198 is oriented in a direction that is parallel with the direction of the ninth longitudinal channel 256.

A portion 350 of the external surface 304 is recessed, thereby forming a raised perimeter wall 352 in the exemplary embodiment; however, other exemplary embodiments have the external surface 304 being substantially planar or being partially raised in different configurations. Additionally, a portion of the first end cap 114 that couples adjacent to the body's opening 230 includes a cut-out 340. The cut-out 340 is used to facilitate installing the lens 190, or any other component of the linear lighting fixture 100. In other exemplary embodiments, the cut-out 340 is optional. As previously mentioned, the second end cap 115 is similar to the first end cap 114, but is coupled to the opposing end of the body 112 according to the manner described.

Figure 4:
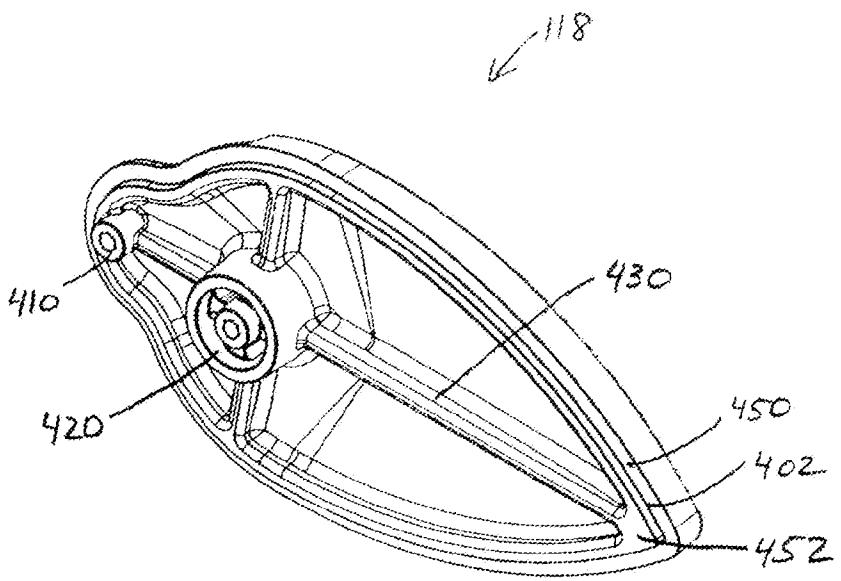
FIG. 4 is a perspective view of the decorative covers of FIG. 1B in accordance with an exemplary embodiment of the present invention.

FIG. 4 is a perspective view of the decorative covers 118 and 119 of FIG. 1B in accordance with an exemplary embodiment of the present invention. Referring to FIGS. 1B, 3, and 4, the first decorative cover 118 and the second decorative cover 119 are similar in construction and are therefore described with respect to the first decorative cover 118. The shape of the decorative covers 118 and 119 is substantially similar to the shape of the first and second end caps 114 and 115, which is substantially arrowhead, or teardrop, in shape. The first decorative cover 118 includes an external surface (not shown), an internal surface 402, a first protrusion 410, and a second protrusion 420.

The first protrusion 410 and the second protrusion 420 are aligned with the aperture 312 and the opening 322, respectively, once the first decorative cover 118 is coupled to the first end cap 114. The first protrusion 410 is shaped to cover and/or fit within the aperture 312. In certain exemplary embodiments, at least a portion of the first protrusion 410 friction fits within the aperture 312. The second protrusion 420 is shaped to cover and/or fit within the opening 322. In certain exemplary embodiments, at least a portion of the second protrusion 420 friction fits within the opening 322. The first protrusion 410 and the second protrusion 420 are supported in proper alignment using one or more support bars 430; however, alternative support mechanisms for positioning the first protrusion 410 and the second protrusion 420, which are known to people having ordinary skill in the art, can be used without departing from the scope and spirit of the exemplary embodiment. Alternatively, one or more of the first protrusion 410 and the second protrusion 420 are optional, since other coupling means, such as screws, fasteners, bolts, or other friction-fitting means, can be used to couple the first decorative cover 118 to the first end cap 114 in alternative exemplary embodiments.

The internal surface 402 includes a perimeter 450 surrounding the first decorative cover 118. A surrounding wall 452 is positioned adjacent and around the inner side of the perimeter 450. The surrounding wall 452 is raised in comparison to the perimeter 450. Once the first decorative cover 118 is coupled to the first end cap 114, the perimeter 450 is positioned adjacent the first end cap's raised perimeter wall 352 and the surrounding wall 452, which is raised, is positioned within the first end cap's recessed portion 350 and adjacent the raised perimeter wall 352. Thus, the first decorative cover 118 is friction-fitted to the first end cap 114. Alternatively, other coupling means, such as screws, fasteners, bolts, or other friction-fitting means, can be used to couple the first decorative cover 118 to the first end cap 114. As previously mentioned, the second decorative cover 119 is similar to the first decorative cover 118, but is coupled to the second end cap 115 according to the manner described. Although end caps 114 and 115 and decorative covers 118 and 119 are used in some exemplary embodiments, other exemplary embodiments use any one of the end caps 114 and 115 or decorative covers 118 and 119.

Figure 5:
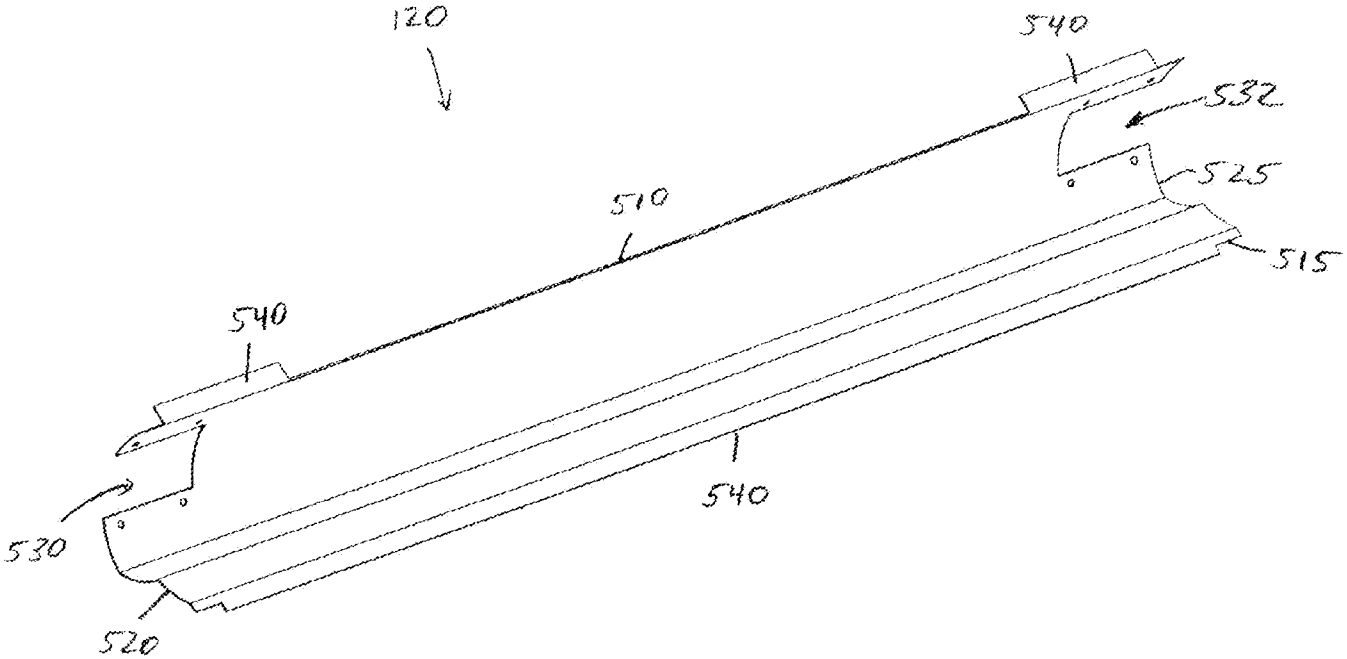
FIG. 5 is a perspective view of the reflector of FIG. 1B in accordance with an exemplary embodiment of the present invention.

FIG. 5 is a perspective view of the reflector 120 of FIG. 1B in accordance with an exemplary embodiment of the present invention. Referring to FIGS. 1B, 1C, and 5, the reflector 120 includes a first longitudinal end 510, a second longitudinal end 515, a first latitudinal end 520, a second latitudinal end 525, a first slot 530, and a second slot 532. In certain other exemplary embodiments, the reflector 120 also includes one or more tabs 540 extending outwardly from each of the first longitudinal end 510 and the second longitudinal end 515.

The reflector 120 is asymmetric in shape and also is substantially concave in shape. The asymmetric reflector 120 provides for an asymmetric light distribution from the light source 105. The first slot 530 extends from a portion of the first latitudinal end 520 and extends a distance towards the second latitudinal end 525. The second slot 532 extends from a portion of the second latitudinal end 525 and extends a distance towards the first latitudinal end 520. The distance that the slots 530 and 532 extend is variable and is determinable by people having ordinary skill in the art with the benefit of the present disclosure. Although the first slot 530 and the second slot 532 extend from the first latitudinal end 520 and the second latitudinal end 525, respectively, one or more of the slots 530 and 532 are entirely surrounded by material used to form the reflector 120 without departing from the scope and spirit of the exemplary embodiment.

The reflector 120 includes a first surface 122 and a second surface 124 and is fabricated using anodized aluminum or any other suitable material known to people having ordinary skill in the art. The reflector 120 is fabricated using any reflective material or any non-reflective material capable of being made reflective. For example, the first surface 122, which is used to reflect the light emitted from the light source 105, is polished or treated, if needed, using known treating methods to enable the material to be reflective.

According to the exemplary embodiment, two tabs 540 are positioned substantially at opposite ends on the first longitudinal end 510 and extend outwardly therefrom. Although two tabs 540 are illustrated in the exemplary embodiment, greater or fewer tabs extending outwardly from the first longitudinal end 510 are used in alternative exemplary embodiments. Similarly, one tab 540 is positioned substantially along the entire length of the second longitudinal end 515 and extends outwardly therefrom. Although one tab 540 is illustrated in the exemplary embodiment, more tabs extending outwardly from the second longitudinal end 515 are used in alternative exemplary embodiments.

The tabs 540 extending from the first longitudinal end 510 are inserted into the first longitudinal channel 240 and the tab 540 extending from the second longitudinal end 515 is inserted into the second longitudinal channel 242. Once the reflector 120 is coupled to the housing 110, the entire reflector 120 is positioned within the cavity 236 (FIG. 2C). The reflector 120 is bendable to allow the tabs 540 to be inserted into both the first longitudinal channel 240 and the second longitudinal channel 542. Thus, the reflector 120 is snap-fitted to the housing 110 and is removable from the housing 110 with or without the use of tools.

Figure 6:
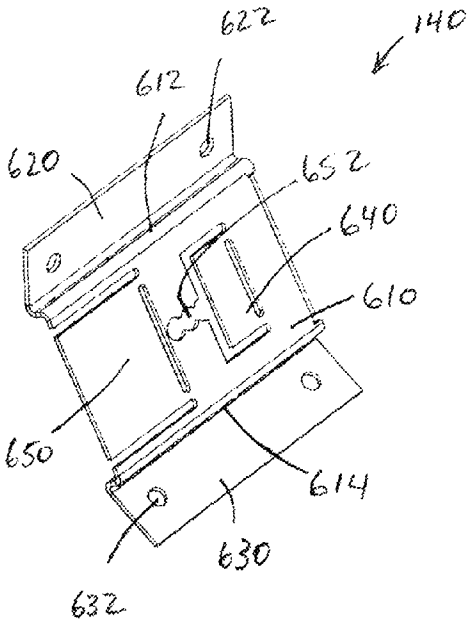
FIG. 6 is a perspective view of the socket bracket of FIG. 1B in accordance with an exemplary embodiment of the present invention.

FIG. 6 is a perspective view of the socket brackets 140 and 150 of FIG. 1B in accordance with an exemplary embodiment of the present invention. Referring to FIGS. 1B and 6, the first socket bracket 140 and the second socket bracket 150 are similar in construction and are therefore described with respect to the first socket bracket 140. The first socket bracket 140 includes a base 610 having a first side 612 and a second side 614, a first mounting section 620 extending from the first side 612, and a second mounting section 630 extending from the second side 614.

The base 610 includes a first socket mounting location 640 and a second socket mounting location 650. In certain exemplary embodiments, the second socket mounting location 650 is configured differently than the first socket mounting location 640 so that different socket types are useable. Additionally, the base 610 includes three overlapping openings 652, where one of the overlapping openings 652 overlaps with the first socket mounting location 640. In certain exemplary embodiments, the overlapping openings 652 are optional. The overlapping openings 652 are used in conjunction with the second socket mounting location 650 and allows for multiple positioning of the socket 151 within the second socket mounting location 650. The first socket mounting location 640 is capable of receiving the socket 151 that is coupleable to a T5 size lamp. The second socket mounting location 650 is capable of receiving the socket 151 that is coupleable to a T8 size lamp. Additionally, since T8 size lamps are of different sizes, the second socket mounting location 650 along with the overlapping openings 652 allow for different size T8 lamps to be coupled to the socket 151 once coupled to the second socket mounting location 650. The size of the T8 lamp that is coupleable to the socket 151 depends upon which of the overlapping openings 652 receive a portion of the socket 151.

The first mounting section 620 extends from substantially the entire first side 612 and includes two holes 622. The second mounting section 630 extends from substantially the entire second side 614 and includes two holes 632. Although each mounting section 620 and 630 has two holes, greater or fewer holes are used in alternative exemplary embodiments. Alternatively, the holes 622 and 632 are optional as other methods known to people having ordinary skill in the art can be used to couple the first socket bracket 140 to the reflector 120.

Figure 7:
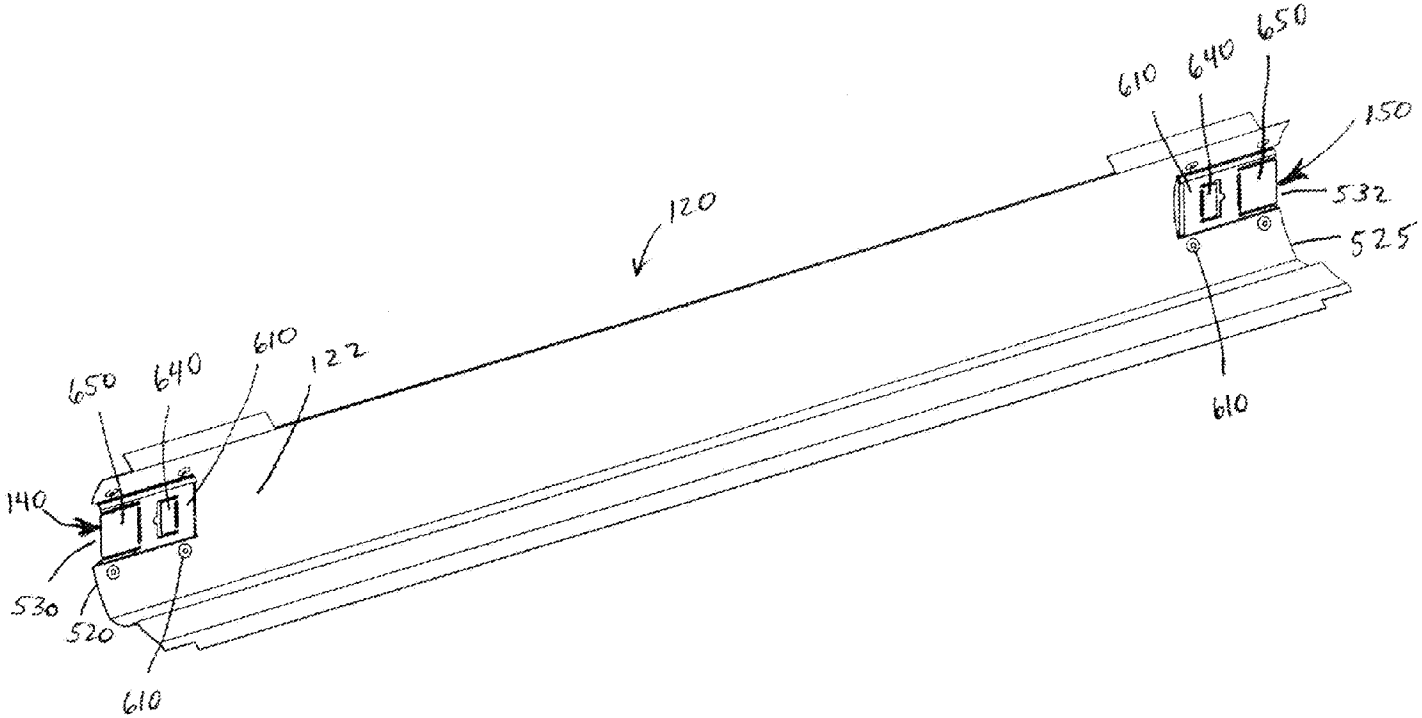
FIG. 7 is a perspective view of the reflector of FIG. 5 and the first and second socket brackets of FIG. 1B mounted thereto in accordance with an exemplary embodiment of the present invention.

FIG. 7 is a perspective view of the reflector 120 of FIG. 5 and the first and second socket brackets 140 and 150 of FIG. 1B mounted thereto in accordance with an exemplary embodiment of the present invention. Referring to FIGS. 1B, 5, 6, and 7, the first and second socket mounting brackets 140 and 150 are coupled to each end of the reflector 120.

The first socket mounting bracket 140 is positioned within the first slot 530 in a first direction. When the first socket mounting bracket 140 is positioned in the first direction, the first latitudinal edge 520 is positioned closer to the second socket mounting location 650 than the first socket mounting location 640. The first socket mounting bracket 140 is coupled to the reflector 120 using one or more fastening devices 610, such as rivets; however, other known fastening devices can be used. The first and second mounting sections 620 and 630 are positioned adjacent the second surface 124 of the reflector 120 so that the base 610 is raised above the first surface 122 of the reflector 120. In other exemplary embodiments, the first socket mounting bracket 140 is configured differently so that the base 610 is not raised above the first surface 122 of the reflector 120 when the first socket mounting bracket 140 is coupled to the reflector 120.

The second socket mounting bracket 150 is positioned within the second slot 532 in a second direction, where the second direction is opposite to the first direction. When the second socket mounting bracket 150 is positioned in the second direction, the second latitudinal edge 525 is positioned closer to the second socket mounting location 650 than the first socket mounting location 640. The second socket mounting bracket 150 is coupled to the reflector 120 using one or more fastening devices 610, such as rivets; however, other known fastening devices can be used. The first and second mounting sections 620 and 630 are positioned adjacent the second surface 124 of the reflector 120 so that the base 610 is raised above the first surface 122 of the reflector 120. In other exemplary embodiments, the second socket mounting bracket 150 is configured differently so that the base 610 is not raised above the first surface 122 of the reflector 120 when the second socket mounting bracket 150 is coupled to the reflector 120. Once the first and second socket mounting brackets 140 and 150 are coupled to the reflector 120, the distance between the two second socket mounting locations 650 of the first and second mounting brackets 140 and 150 is greater than the distance between the two first socket mounting locations 640 of the first and second mounting brackets 140 and 150.

When each socket mounting bracket 140 and 150 receives the socket 151 at the respective first socket mounting locations 640, a light source 105 having a first length is coupleable to each of the sockets 151. In one exemplary embodiment, a T5 size lamp is coupleable between the sockets 151 positioned in the first socket mounting locations 640 of each socket mounting bracket 140 and 150. Alternatively, when each socket mounting bracket 140 and 150 receives the socket 151 at the respective second socket mounting locations 650, a light source 105 having a second length, which is different than the first length, is coupleable to each of the sockets 151. In one exemplary embodiment, a T8 size lamp is coupleable between the sockets 151 positioned in the second socket mounting locations 650 of each socket mounting bracket 140 and 150. Although the first and second socket mounting brackets 140 and 150 are coupled to the reflector 120, at least one of the first and second socket mounting brackets 140 and 150 is coupled to the reflector 120 in another exemplary embodiment. Additionally, some exemplary embodiments have at least one of the first and second socket mounting brackets 140 and 150 being coupled to the housing 110. Although two lamp sizes T5 and T8 are described as being coupleable to the sockets 151, the first and second socket mounting brackets are configured differently to receive other lamp sizes in alternative exemplary embodiments.

Once the first and second socket mounting brackets 140 and 150 are coupled to the reflector 120 and the sockets 151 are coupled to the respective first or second socket mounting brackets 140 and 150, the electrical wires (not shown) from the ballast 205 (FIG. 2A) are coupled to the sockets 151. The reflector 120 is then removably snap-fitted to the housing 110 without the use of tools, in the manner previously described, so that access can be made to the internal wires and/or the ballast (FIG. 2A) without the use of tools. Thus, the reflector 120 is installed and unassembled to and from the housing 110 without the use of tools. The reflector 120 is positioned between the internal components 205 (FIG. 2A) and the opening 230 (FIG. 2A) of the housing 110, thereby concealing the internal components 205 (FIG. 2A) from view once the fixture 100 is assembled.

Figure 8:
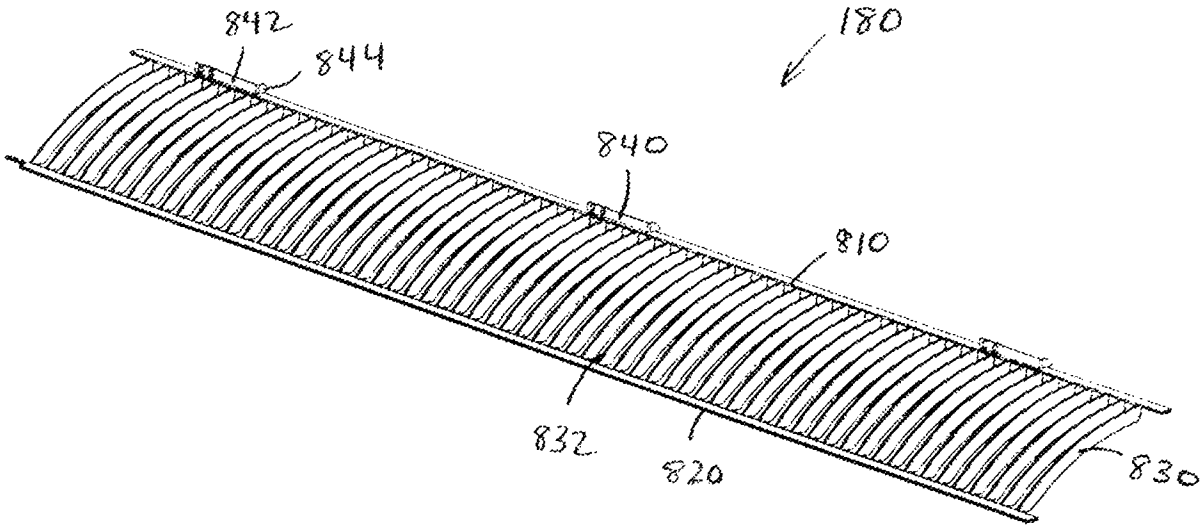
FIG. 8 is a perspective view of the louver of FIG. 1B in accordance with an exemplary embodiment of the present invention.

FIG. 8 is a perspective view of the louver 180 of FIG. 1B in accordance with an exemplary embodiment of the present invention. Referring to FIGS. 1B, 1C, and 8, the louver 180 includes a first longitudinal edge 810, a second longitudinal edge 820 parallel to the first longitudinal edge 810, one or more louver bars 830 extending transversely from the first longitudinal edge 810 to the second longitudinal edge 820, and one or more fasteners 840 positioned along at least one of the longitudinal edges 810 and 820.

The louver 180 is fabricated using a metal, metal alloy, plastic, or other suitable material known to people having ordinary skill in the art. The louver 180 provides glare control and is an optional component that is usable with or without the lens 190 within the same fixture 100. The louver bars 830 extend transversely from the first longitudinal edge 810 to the second longitudinal edge 820 and form a gap 832 between adjacent louver bars 830. The louver bars 830 are formed having a curvature, where the apex of the curvature is closer to the opening 230 (FIG. 2A) once the louver 180 is coupled to the housing 110. However, other exemplary embodiments have louver bars 830 with different shapes, for example, linear or curved in an opposite direction, without departing from the scope and spirit of the exemplary embodiment.

The fasteners 840 are coupled to the first longitudinal edge 810, wherein a portion of the fasteners 840 extend outwardly beyond the profile of the first longitudinal edge 810. In one exemplary embodiment, there are three fasteners 840 coupled to the first longitudinal edge 810; however, the number of fasteners 840 is greater or fewer in other exemplary embodiments. One example of the fasteners 840 is clips 840, as shown in FIG. 8. The clips 840 includes a first portion 842 and a second portion 844, where the second portion 844 is positioned transversely to the first portion 842. The first portion 842 is positioned along the same direction as the first longitudinal edge 810. A portion of the second portion 844 extends outwardly beyond the profile of the first longitudinal edge 810. Although one example of a fastener 840 is illustrated, other types of fasteners including, but not limited to, screws, other clip types, or hinges, are used in alternative exemplary embodiments.

To couple the louver 180 to the housing 110, the second longitudinal edge 820 of the louver 180 is positioned within at least a portion of the second longitudinal channel 242. The first longitudinal edge 810 of the louver 180 is positioned adjacent the first longitudinal channel 240 such that a portion of the fastener 840 is snapped into positioned within a portion of the first longitudinal channel 240. The fastener 840 securely couples the louver 180 to the housing 110. Thus, once the louver 180 is coupled to the housing 110, the first longitudinal edge 810 is disposed between the first longitudinal end 510 (FIG. 5) and the first longitudinal side 232 (FIG. 2C). Similarly, the second longitudinal edge 820 is disposed between the second longitudinal end 515 (FIG. 5) and the second longitudinal side 234 (FIG. 2C). The louver 180 is removably snap-fitted to the housing 110 without the use of tools, in the manner described, so that one or ore of the reflector 110, the internal wires, and/or the ballast (FIG. 2A) is accessible without the use of tools. Thus, the louver 180 is installed and unassembled to and from the housing without the use of tools. The louver 180 is positioned between the reflector 120 and the opening 230 (FIG. 2A) of the housing 110.

Figure 9:
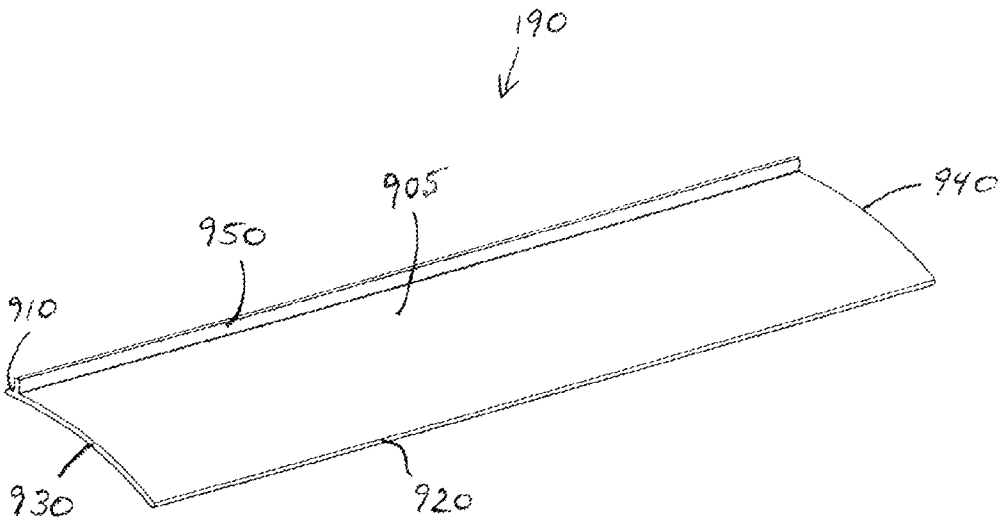
FIG. 9 is a perspective view of the lens of FIG. 1B in accordance with an exemplary embodiment of the present invention.

FIG. 9 is a perspective view of the lens 190 of FIG. 1B in accordance with an exemplary embodiment of the present invention. Referring to FIGS. 1B, 1C, and 9, the lens 190 includes a first longitudinal boundary 910, a second longitudinal boundary 920, a first latitudinal boundary 930, a second latitudinal boundary 940, and a grip bar 950.

The lens 190 is fabricated using an acrylic material that is at least slightly flexible, but is fabricated using any other suitable material known to people having ordinary skill in the art, such as plastic or any other translucent or transparent material in other exemplary embodiments. The lens 190 provides protection to the performance of the fixture 100 by sealing out dust, insects, and other contaminants that diminish optical performance. The lens 190 is optional and is used with or without the louver 180 within the same fixture 100. The lens 190 is formed having a curvature, where the apex of the curvature is closer to the opening 230 (FIG. 2A) once the lens 190 is coupled to the housing 110. However, other exemplary embodiments have lens 190 with different shapes, for example, linear or curved in an opposite direction, without departing from the scope and spirit of the exemplary embodiment. Additionally, according to other exemplary embodiments, the lens 190 includes prisms and/or facets to control the light output from the fixture 100.

The lens 190 also includes a light emitting side 905, wherein the grip bar 950 extends outwardly from the light emitting side 905 adjacent the first longitudinal boundary 910 and substantially along the entire longitudinal length of the lens 190. The grip bar 950 facilitates a user in coupling or disassembling the lens 190 to or from the housing 110. The user applies force to the grip bar 950 in a direction towards the second longitudinal boundary 920 once the second longitudinal boundary 920 is inserted within the fourth longitudinal channel 246, thereby slightly bending the lens 190.

To couple the lens 190 to the housing 110, the second longitudinal boundary 920 of the lens 190 is positioned within at least a portion of the fourth longitudinal channel 246. The first longitudinal boundary 910 of the lens 190 is positioned adjacent the third longitudinal channel 244 and inserted into the third longitudinal channel 244 by applying force to the grip bar 950 in the manner previously described and slightly bending the lens 190. Once the lens 190 slightly bends, the first longitudinal boundary 910 of the lens 190 is snapped into positioned within a portion of the third longitudinal channel 244. Thus, once the lens 190 is coupled to the housing 110, the first longitudinal boundary 910 is disposed between the first longitudinal end 510 (FIG. 5) and the first longitudinal side 232 (FIG. 2C). Similarly, the second longitudinal boundary 920 is disposed between the second longitudinal end 515 (FIG. 5) and the second longitudinal side 234 (FIG. 2C). The first latitudinal boundary 930 is positioned within the cut-out 340 (FIG. 3) of the first end cap 114, while the second latitudinal boundary 940 is positioned within the cut-out 340 (FIG. 3) of the second end cap 115. The lens 190 is removably snap-fitted to the housing 110 without the use of tools, in the manner described, so that at least one of the reflector 110, the internal wires, the ballast (FIG. 2A), and/or the louver 180 is accessible without the use of tools. Thus, the lens 190 is installed and unassembled to and from the housing without the use of tools. The lens 190 is positioned between the reflector 120 and the opening 230 (FIG. 2A) of the housing 110.

As previously mentioned, the lens 190 is an optional component and is used with or without the use of the louver 180 within the same fixture 100. Although one exemplary embodiment has been described where the longitudinal channels are disposed within the cavity 236 (FIG. 2B) thereby having the reflector 120, the louver 180, and the lens 190 positioned within the cavity 236 (FIG. 2B), other exemplary embodiments have one or more longitudinal channels being disposed adjacent the opening 230 (FIG. 2B, but outside the cavity 236 (FIG. 2B), thereby having one or more of the reflector 120, the louver 180, and the lens 190 being positioned outside the cavity 236 (FIG. 2B).

Figure 10:
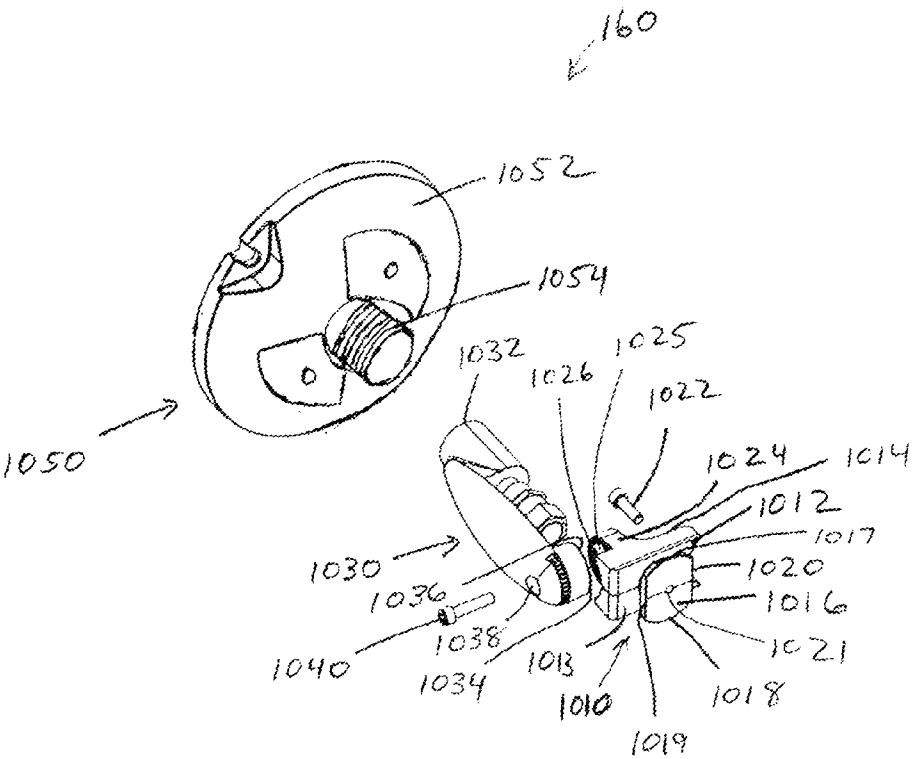
FIG. 10 is an exploded view of the mounting assemblies of FIG. 1A in accordance with an exemplary embodiment of the present invention.

FIG. 10 is an exploded view of the mounting assemblies 160 and 170 of FIG. 1A in accordance with an exemplary embodiment of the present invention. Referring to FIGS. 1A, 2B, and 10, the first mounting assembly 160 and the second mounting assembly 170 are similar in construction, except that one of the mounting assemblies 160 and 170 are designed to receive an electrical wire (not shown) that is coupled from the power source to the ballast 205 (FIG. 2A). Therefore, both the first mounting assembly 160 and the second mounting assembly 170 are described with respect to the first mounting assembly 160. The first mounting assembly 160 includes a knuckle base 1010, a knuckle arm 1030, and a wall plate 1050.

The knuckle base 1010 includes a base 1012, a raised mount 1016, and a knuckle arm coupler 1024. The base 1012, the raised mount 1016, and the knuckle arm coupler 1024 are integrally formed, however, one or more of the raised mount 1016 and the knuckle arm coupler 1024 are separately formed and thereafter coupled to the base 1012. The base 1012 includes a first surface 1013 and a second surface 1014 and is substantially planar; but is non-planar in other exemplary embodiments.

The raised mount 1016 extends from the first surface 1013 and has a first edge 1017, a second edge 1018 located opposite the first edge 1017, a third edge 1019, and a fourth edge 1020 located opposite the third edge 1019. The first and second edges 1017 and 1018 are curved-shape, while the third and fourth edges 1019 and 1020 are substantially linear. The third and fourth edges 1019 and 1020 extend a distance that is slightly less than the width of the track 208, but slightly more than the distance between the two lips 209 of the track 208. The first and second edges 1017 and 1018 are curved-shape so that the raised mount 1016 is rotatable within the track 208 once inserted therein. A first opening 1021 extends from the second surface 1014 of the base 1012 and through the raised mount 1016. The first opening 1021 receives a first bolt 1022 from the second surface 1014, which facilitates coupling of the first mounting assembly 160 to the to the track 208. Although the first bolt 1022 is used to couple the first mounting assembly 160 to the track 208, other devices, such as screws, pins, or other suitable devices, are used to couple the first mounting assembly 160 to the track 208 in other exemplary embodiments.

The knuckle arm coupler 1024 extends from the second surface 1014 in a direction opposite to the direction of the raised mount 1016. The knuckle arm coupler 1024 includes a first face 1025 that faces a direction that is substantially transverse to the direction that the knuckle arm coupler 1024 extends. The first face 1025 includes a second opening 1026 that extends a portion through the knuckle arm coupler 1024; however, alternative exemplary embodiments have the second opening 1026 extending through the knuckle arm coupler 1024.

The knuckle arm 1030 includes a first end 1032 and a second end 1034. The first end 1032 is hollow and is coupleable to the wall plate 1050, which is described in further below. The second end 1034 includes a second face 1036, which faces a substantially transverse direction with respect to the direction of the knuckle arm's 1030 length. The second face 1036 includes a third opening 1038 that proceeds from the surface of the second face 1036 and through the knuckle arm 1030. The third opening 1038 is aligned with the second opening 1026 such that the first face 1025 is positioned adjacent to the second face 1036. Once the knuckle arm 1030 is properly positioned with the knuckle base 1010, a second bolt 1040 is inserted through the third opening 1038 and allowed to proceed into the second opening 1026 to securely and rotatably couple the knuckle arm 1030 to the knuckle base 1010. Although the second bolt 1040 is used to couple the knuckle arm 1030 to the knuckle base 1010, other devices, such as screws, pins, or other suitable devices, are used to couple the knuckle arm 1030 to the knuckle base 1010 in other exemplary embodiments. This rotatable coupling allows the housing 110 to be rotatable once the mounting assemblies 160 and 170 are fixedly mounted to a surface (not shown). In certain exemplary embodiments, the housing 110 is rotatable to any degree within a 180 degree range. Once the housing is in the proper orientation, the second bolt 1040 is tightened to securely orient the housing 110 so that it does not inadvertently rotate. In other exemplary embodiments, the housing 110 is not rotatable.

The wall plate 1050 includes a mounting portion 1052 and a connector 1054 extending outwardly from the mounting portion 1052 in a substantially transverse manner. In some exemplary embodiments, the connector 1054 extends outwardly from a center of the mounting portion 1052. Although the mounting portion 1052 is substantially disc shaped, the mounting portion 1052 is shaped in any other geometric or non-geometric shape according to other exemplary embodiments. The mounting portion 1052 is coupled to a surface (not shown) to mount the fixture 100. Additionally, although the connector 1054 is illustrated as a threaded male connector, the connector 1054 is a threaded female connector or any other suitable connecting device, such as a friction fitting device or a snap-fitting device, in other exemplary embodiments. According to some exemplary embodiments, the connector 1054 is coupled to the first end 1032 of the knuckle arm 1030.

To couple the first mounting assembly 160 to the track 208, the raised mount 1016 is inserted within the track 208 at a first location, where the first and second edges 1017 and 1018 are substantially perpendicular to the length of the track 208. The first mounting assembly 160 is then adjusted to a desired location, if needed. In some exemplary embodiments, the first mounting assembly 160 is slidably adjusted to a desired location within the track 208. The desired location is one of various locations along the track 208 that the first mounting assembly 160 is coupleable to. For example, the desired location is a location along the track 208 which aligns with a stud, a J-box, or any other surface mounting structure when the fixture 100 is coupled to the surface according to some exemplary embodiments. Once the first mounting assembly 160 is positioned in the desired location, the first mounting assembly 160 is rotated ninety degrees so that the first and second edges 1017 and 1018 of the raised mount 1016 are substantially parallel to the length of the track 208 and positioned under the lip 209 of the track 208. The first bolt 1022 is then tightened so that it extends through the raised mount 1016, makes contact with the exterior surface 212 of the bottom side 210, and moves the raised mount 1016 off of the exterior surface 212 until the raised mount 1016 forms a secure contact with the lip 209. The second mounting assembly 170 is coupled to the track 208 in a similar manner.

Figure 11:
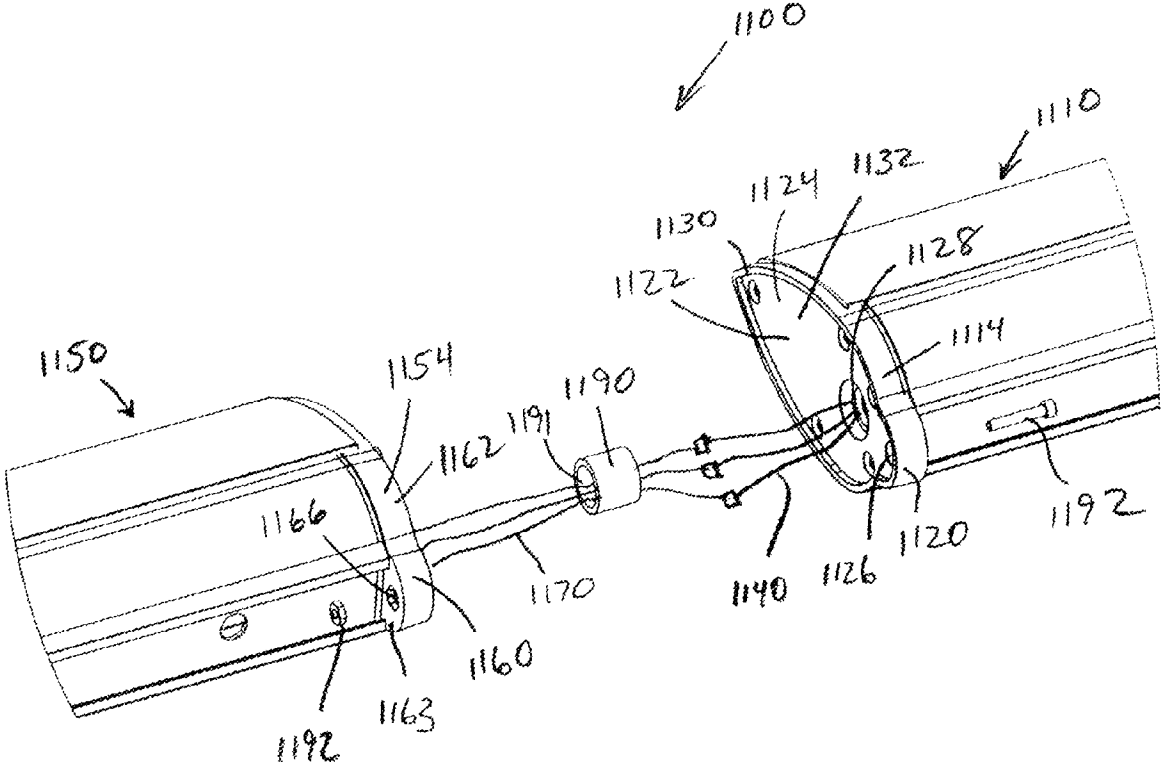
FIG. 11 is an exploded view of an asymmetric continuous linear lighting fixture system in accordance with an exemplary embodiment of the present invention.

FIG. 11 is an exploded view of an asymmetric continuous linear lighting fixture system 1100 in accordance with an exemplary embodiment of the present invention. The asymmetric continuous linear lighting fixture system 1100 includes a first asymmetric linear lighting fixture 1110 continuously coupled to a second asymmetric linear lighting fixture 1150.

The first asymmetric linear lighting fixture 1110 is constructed similarly to the asymmetric linear lighting fixture 100 of FIGS. 1A-10 except that the one end of the first asymmetric linear lighting fixture 1110 includes a first end cap 1114 that is similar to the first end cap 114 (FIG. 1B) without the first decorative cover 118 (FIG. 1B). Similar to the first end cap 114 (FIG. 1B), the first end cap 1114 includes a first portion 1120, a second portion 1122, an internal surface (not shown), and an external surface 1124. The external surface 1124 includes a raised perimeter wall 1130 and a recessed portion 1132 located within the area bordered by the raised perimeter wall 1130. The first portion 1120 includes an aperture 1126, similar to the aperture 312 (FIG. 3). The second portion 1122 includes an opening 1128 similar to the opening 322 (FIG. 3).

Similarly, the second asymmetric linear lighting fixture 1150 is constructed similarly to the asymmetric linear lighting fixture 100 of FIGS. 1A-10 except that the opposing end of the second asymmetric linear lighting fixture 1150 includes a second end cap 1154 that is similar to the second end cap 115 (FIG. 1B) without the second decorative cover 119 (FIG. 1B). Similar to the first end cap 114 (FIG. 1B), the second end cap 1154 includes a first portion 1160, a second portion 1162, an internal surface 1163, and an external surface (not shown). The external surface includes a raised perimeter wall (not shown) and a recessed portion (not shown) located within the area bordered by the raised perimeter wall, which is similar to the external surface 1124. The first portion 1160 includes an aperture 1166, similar to the aperture 312 (FIG. 3). The second portion 1162 includes an opening (not shown) similar to the opening 322 (FIG. 3).

The second end cap 1154 of the second asymmetric linear lighting fixture 1150 couples to the first end cap 1114 of the first asymmetric linear lighting fixture 1110 using a coupling 1190 and a fastener 1192. One or more electrical wires 1140 are extended from the first asymmetric linear lighting fixture 1110 and through the opening 1128. Similarly, one or more electrical wires 1170 are extended from the second asymmetric linear lighting fixture 1150 and through the opening 1168. At least one group of the electrical wires 1440 and 1170 pass through a channel 1191 formed within the coupling 1190 and are electrically coupled to the other group of electrical wires 1140 and 1170.

The coupling 1190 is fabricated using a rubber, plastic, or other suitable material that forms a seal once the second asymmetric linear lighting fixture 1150 is coupled to the first asymmetric linear lighting fixture 1110. In certain exemplary embodiments, the coupling 1190 is compressible one pressure is applied to both ends. In certain exemplary embodiments, the seal is water-tight. In other exemplary embodiments, the coupling 1190 is optional.

The first end cap 1114 of the first asymmetric linear lighting fixture 1110 is positioned adjacent the second end cap 1154 of the second asymmetric linear lighting fixture 1150 with the coupling 1190 being positioned therebetween and adjacent each of the openings 1128. In certain exemplary embodiments, a portion of each end of the coupling 1190 is partially inserted within each respective opening 1128. Once the first asymmetric linear lighting fixture 1110 is properly positioned adjacent the second asymmetric linear lighting fixture 1150, the fastener 1192 is inserted within both apertures 1126 and 1166 to securely couple the first asymmetric linear lighting fixture 1110 to the second asymmetric linear lighting fixture 1150. In one exemplary embodiment, the fastener 1192 is a bolt and a nut; but other suitable fasteners known to people having ordinary skill in the art is used in other exemplary embodiments.

Although two asymmetric lighting fixtures 1110 and 1150 are illustrated in the system 1100, any number of asymmetric lighting fixtures 1110 and 1150 are coupled together to form the system 1100. Thus, to couple a third asymmetric lighting fixture to the second asymmetric lighting fixture 1150, the first decorative cover (not shown) of the second asymmetric lighting fixture 1150 is removed, or not installed, and coupled to the first end cap of the third asymmetric lighting fixture pursuant to the method described above.

Although each exemplary embodiment has been described in detail, it is to be construed that any features and modifications that are applicable to one embodiment are also applicable to the other embodiments. Furthermore, although the invention has been described with reference to specific embodiments, these descriptions are not meant to be construed in a limiting sense. Various modifications of the disclosed embodiments, as well as alternative embodiments of the invention will become apparent to persons of ordinary skill in the art upon reference to the description of the exemplary embodiments. It should be appreciated by those of ordinary skill in the art that the conception and the specific embodiments disclosed may be readily utilized as a basis for modifying or designing other structures or methods for carrying out the same purposes of the invention. It should also be realized by those of ordinary skill in the art that such equivalent constructions do not depart from the spirit and scope of the invention as set forth in the appended claims. It is therefore, contemplated that the claims will cover any such modifications or embodiments that fall within the scope of the invention.

What is claimed is:

1. An asymmetric linear lighting fixture, comprising:

a linear housing comprising an internal surface and an external surface, the housing forming an opening along a portion of the external surface and a cavity extending from the opening into the interior of the housing thereby forming the internal surface;

one or more internal components coupled to a portion of the housing within the cavity;

an asymmetric reflector being removably snap-fitted to the housing and disposed within the cavity, wherein the asymmetric reflector is positioned between the internal components and the opening; and a louver, the louver comprising a first longitudinal edge and a second longitudinal edge, the first longitudinal edge comprising one or more fasteners, wherein at least a portion of the fasteners is positioned within a portion of a first longitudinal channel, the second longitudinal edge positioned within at least a portion of a second longitudinal channel, wherein the louver is removably snap-fitted to the housing and disposed adjacent the asymmetric reflector, wherein the opening comprises a first longitudinal side and a second longitudinal side extending substantially the length of a portion of the external surface of the housing, wherein the housing comprises the first longitudinal channel and the second longitudinal channel, the second longitudinal channel being substantially parallel to the first longitudinal channel, the first and second longitudinal channels being positioned adjacent the first and second longitudinal sides respectively, wherein the asymmetric reflector comprises a first longitudinal end and a second longitudinal end, the first longitudinal end comprising one or more tabs extending outwardly therefrom, the second longitudinal end comprising one or more tabs extending outwardly therefrom, and wherein each of the tabs of the first longitudinal end is positioned within at least a portion of the first longitudinal channel and each of the tabs of the second longitudinal end is positioned within at least a portion of the second longitudinal channel, thereby removably snap-fitting the asymmetric reflector to the housing.

2. The asymmetric linear lighting fixture of claim 1, wherein the one or more internal components comprises a ballast.

3. The asymmetric linear lighting fixture of claim 1, further comprising a lens, the lens being removably snap-fitted to the housing and disposed adjacent the louver, wherein the louver is positioned between the asymmetric reflector and the lens.

4. The asymmetric linear lighting fixture of claim 1, further comprising a lens, the lens being removably snap-fitted to the housing and disposed adjacent the asymmetric reflector.

5. The asymmetric linear lighting fixture of claim 1, wherein the tabs extend substantially the length of the asymmetric reflector.

6. The asymmetric linear lighting fixture of claim 1, further comprising a lens, the lens comprising a first longitudinal boundary and a second longitudinal boundary, wherein the linear housing further comprises:

a third longitudinal channel positioned between the first longitudinal channel and the first longitudinal side; and a fourth longitudinal channel positioned between the second longitudinal channel and the second longitudinal side, wherein the first longitudinal boundary is positioned within at least a portion of the third longitudinal channel, and wherein the second longitudinal boundary is positioned within at least a portion of the fourth longitudinal channel, and wherein the lens is removably snap-fitted to the housing.

7. The asymmetric linear lighting fixture of claim 1, wherein the linear housing further comprises:

a body comprising a longitudinal bottom side and a longitudinal top side parallel to the longitudinal bottom side;

a first end cap coupled to one end of the body; and a second end cap coupled to an opposing end of the body, wherein at least a portion of at least one of the first and second end caps extends beyond the profile of the body, the portion comprising a passageway to receive a fastener for coupling the asymmetric linear lighting fixture adjacently to a second asymmetric linear lighting fixture.

8. An asymmetric linear lighting fixture, comprising:

a linear housing comprising an internal surface and an external surface, the housing forming an opening along a portion of the external surface and a cavity extending from the opening into the interior of the housing thereby forming the internal surface;

one or more internal components coupled to a portion of the housing within the cavity;

an asymmetric reflector being removably snap-fitted to the housing and disposed within the cavity, wherein the asymmetric reflector is positioned between the internal components and the opening; and a louver, the louver being removably snap-fitted to the housing and disposed adjacent the asymmetric reflector; and one or more mounting assemblies, wherein the linear housing further comprises a bottom side, the external surface of the bottom side comprising one or more tracks extending at least a portion of the length of the housing, wherein the one or more mounting assemblies are securely coupled to a desired location along the track, the one or more mounting assemblies being positionable at various locations along the track.

9. The asymmetric linear lighting fixture of claim 8, wherein the mounting assemblies are mounted to a surface and allow the housing to rotate and change the orientation of the housing once mounted to the surface.

10. The asymmetric linear lighting fixture of claim 8, further comprising a lens, the lens being removably snap-fitted to the housing and disposed adjacent the louver, wherein the louver is positioned between the asymmetric reflector and the lens.

11. The asymmetric linear lighting fixture of claim 8, further comprising a lens, the lens being removably snap-fitted to the housing and disposed adjacent the asymmetric reflector.

12. An asymmetric linear lighting fixture,comprising:

a linear housing comprising an internal surface and an external surface, the housing forming an opening along a portion of the external surface and a cavity extending from the opening into the interior of the housing thereby forming the internal surface;

one or more internal components coupled to a portion of the housing within the cavity;

an asymmetric reflector being removably snap-fitted to the housing and disposed within the cavity, wherein the asymmetric reflector is positioned between the internal components and the opening;

a first socket mounting bracket coupled to substantially one end of the reflector in a first direction; and a second socket mounting bracket coupled substantially to an opposing end of the reflector in a second direction, wherein the first direction is opposite the second direction, wherein each socket mounting bracket comprises at least a first socket mounting location and a second socket mounting location, wherein when each socket mounting bracket receives a socket at the first socket mounting locations, a light source comprising a first length is coupleable to each of the sockets, and wherein when each socket mounting bracket receives a socket at the second socket mounting locations, a light source comprising a second length is coupleable to each of the sockets, the first length being different than the second length.

13. The asymmetric linear lighting fixture of claim 12, further comprising a louver, the louver being removably snap-fitted to the housing and disposed adjacent the asymmetric reflector.

14. The asymmetric linear lighting fixture of claim 13, further comprising a lens, the lens being removably snap-fitted to the housing and disposed adjacent the louver, wherein the louver is positioned between the asymmetric reflector and the lens.

15. The asymmetric linear lighting fixture of claim 12, further comprising a lens, the lens being removably snap-fitted to the housing and disposed adjacent the asymmetric reflector.

* * * * *